US010815979B2

(12) United States Patent
Ignatiev et al.

(10) Patent No.: US 10,815,979 B2
(45) **Date of Patent: *Oct. 27, 2020**

(54) RECIPROCATING COMPRESSOR HAVING FIRST AND SECOND CYLINDERS IN SELECTIVE FLUID COMMUNICATION WITH RESPECTIVE FIRST AND SECOND SUCTION PLENUMS

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 185 days.

This patent is subject to a terminal disclaimer.

(21) Appl. No.: 15/948,427

(22) Filed: Apr. 9, 2018

(65) Prior Publication Data

US 2018/0223820 A1 Aug. 9, 2018

Related U.S. Application Data

(63) Continuation of application No. 14/880,867, filed on Oct. 12, 2015, now Pat. No. 9,938,967.

(Continued)

(51) Int. Cl.
*F04B 27/067* (2006.01)
*F04B 35/01* (2006.01)

(Continued)

(52) U.S. Cl.
CPC ..... *F04B 27/067* (2013.01); *F04B 25/005* (2013.01); *F04B 27/0673* (2013.01);

(Continued)

(58) Field of Classification Search
CPC .. F04B 25/005; F04B 27/067; F04B 27/0673; F04B 35/01; F04B 39/0016;

(Continued)

(56) References Cited

U.S. PATENT DOCUMENTS 1,528,086 A * 3/1925 Scovel, Jr. ..... F04B 39/0016 417/504
1,746,394 A 2/1930 Guild (Continued)

FOREIGN PATENT DOCUMENTS

CN 1363018 A 8/2002
CN 1916406 A 2/2007

(Continued)

OTHER PUBLICATIONS

Office Action regarding Chinese Patent Application No. 201580059547.1, dated Jun. 5, 2018. Translation provided by Unitalen Attorneys at Law.

(Continued)

*Primary Examiner* — Devon C Kramer
*Assistant Examiner* — Benjamin Doyle
(74) *Attorney, Agent, or Firm* — Harness, Dickey & Pierce, P.L.C.

(57) ABSTRACT

A compressor may include a crankcase, a crankshaft, a piston, a discharge valve and a suction plenum. The crankcase defines a discharge plenum receiving working fluid at a first pressure. The crankshaft is disposed within the discharge plenum. The piston is drivingly connected to the crankshaft and reciprocatingly received in a cylinder. The piston and cylinder cooperate to define a compression chamber therebetween. The discharge valve may control fluid flow through a discharge passage between the compression chamber and the discharge plenum. The suction plenum may receive working fluid at a second pressure that is less than (Continued)

the first pressure. The suction plenum may provide working fluid at the second pressure to the compression chamber.

21 Claims, 8 Drawing Sheets

Related U.S. Application Data

(60) Provisional application No. 62/069,995, filed on Oct. 29, 2014.

(51) Int. Cl.

| | |
|---|---|
| ***F04B 39/00*** | (2006.01) |
| ***F04B 39/10*** | (2006.01) |
| ***F04B 49/00*** | (2006.01) |
| ***F04B 25/00*** | (2006.01) |
| ***F04B 49/24*** | (2006.01) |
| ***F04B 49/22*** | (2006.01) |

(52) U.S. Cl.
CPC ..... *F04B 35/01* (2013.01); *F04B 39/0016* (2013.01); *F04B 39/0094* (2013.01); *F04B 39/10* (2013.01); *F04B 49/007* (2013.01); *F04B 49/22* (2013.01); *F04B 49/24* (2013.01)

(58) Field of Classification Search
CPC .... F04B 39/0094; F04B 39/10; F04B 49/007; F04B 49/22; F04B 49/24
USPC ..... 417/545
See application file for complete search history.

(56) References Cited

U.S. PATENT DOCUMENTS

| | | | | |
|---|---|---|---|---|
| 3,181,779 | A | 5/1965 | Rhodes | |
| 3,194,486 | A | 7/1965 | Stanislas | |
| 3,338,509 | A | 8/1967 | McAninch | |
| 4,838,769 | A | 6/1989 | Gannaway | |
| 5,600,961 | A | 2/1997 | Whipple, III | |
| 6,352,057 | B1 * | 3/2002 | Drecq | F02B 33/20 123/197.3 |
| 6,666,656 | B2 * | 12/2003 | Pressel | F04B 27/0878 137/512.3 |
| 7,226,276 | B2 | 6/2007 | Bez et al. | |
| 7,437,989 | B2 | 10/2008 | Yoon et al. | |
| 9,476,414 | B2 | 10/2016 | Wallis | |
| 9,624,918 | B2 * | 4/2017 | Goertzen | F04B 25/00 |
| 9,938,967 | B2 * | 4/2018 | Ignatiev | F04B 39/10 |
| 2002/0062657 | A1 | 5/2002 | Dittrich | |
| 2004/0228737 | A1 | 11/2004 | Folchert | |
| 2007/0041847 | A1 | 2/2007 | Inoue et al. | |
| 2008/0003115 | A1 | 1/2008 | Kim | |
| 2009/0047159 | A1 * | 2/2009 | Inoue | F04B 25/00 417/521 |
| 2010/0303645 | A1 | 12/2010 | Ohata et al. | |
| 2011/0256001 | A1 | 10/2011 | Kobayashi et al. | |
| 2012/0067306 | A1 | 3/2012 | Mehring et al. | |
| 2014/0170003 | A1 | 6/2014 | Bergman et al. | |

FOREIGN PATENT DOCUMENTS

| | | | |
|---|---|---|---|
| CN | 102213207 | A | 10/2011 |
| CN | 102220957 | A | 10/2011 |
| CN | 102235224 | A | 11/2011 |
| EP | 0715077 | A2 | 6/1996 |
| EP | 0718568 | A2 | 6/1996 |
| WO | WO-2013126971 | A2 | 9/2013 |
| WO | WO-2013180538 | A1 | 12/2013 |

OTHER PUBLICATIONS

Search Report regarding European Patent Application No. 15855637.3, dated Jul. 17, 2018.
International Search Report dated Jan. 27, 2016 regarding International Application No. PCT/US2015/057679.
Written Opinion of the International Searching Authority for International Application No. PCT/US2015/057679 dated Jan. 27, 2016.
Office Action regarding U.S. Appl. No. 14/880,867, dated Feb. 24, 2017.
Office Action regarding U.S. Appl. No. 14/880,867, dated Jul. 25, 2017.

* cited by examiner

RECIPROCATING COMPRESSOR HAVING FIRST AND SECOND CYLINDERS IN SELECTIVE FLUID COMMUNICATION WITH RESPECTIVE FIRST AND SECOND SUCTION PLENUMS

CROSS-REFERENCE TO RELATED APPLICATIONS

This application is a continuation of U.S. application Ser. No. 14/880,867, filed on Oct. 12, 2015, which claims the benefit of U.S. Provisional Application No. 62/069,995, filed on Oct. 29, 2014. The entire disclosures of the above applications are incorporated herein by reference.

FIELD

The present disclosure relates to a reciprocating compressor system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Varying a capacity of the compressor can impact the energy-efficiency of the system and the speed with which the system is able to heat or cool a room or space.

SUMMARY

This section provides a general summary of the disclosure, and is not a comprehensive disclosure of its full scope or all of its features.

In one form, the present disclosure provides a compressor that may include a crankcase, a crankshaft, a piston, a discharge valve and a suction plenum. The crankcase defines a discharge plenum receiving working fluid at a first pressure. The crankshaft is disposed within the discharge plenum. The piston is drivingly connected to the crankshaft and reciprocatingly received in a cylinder. The piston and cylinder cooperate to define a compression chamber therebetween. The discharge valve may control fluid flow through a discharge passage between the compression chamber and the discharge plenum. The suction plenum may receive working fluid at a second pressure that is less than the first pressure. The suction plenum may provide working fluid at the second pressure to the compression chamber.

In some embodiments, the discharge passage extends through the piston. The discharge valve may be mounted to the piston and may move with the piston relative to the cylinder.

In some embodiments, the piston is disposed between the suction plenum and the discharge plenum.

In some embodiments, the suction plenum is defined by a cylinder head plate defining an axial end of the cylinder.

In some embodiments, the compressor includes a suction valve controlling fluid flow through a suction passage in the cylinder head plate between the suction plenum and the compression chamber.

In some embodiments, the suction plenum includes a suction inlet through which working fluid at the second pressure enters the compressor.

In some embodiments, the crankcase defines a discharge outlet through which working fluid at the first pressure exits the compressor.

In some embodiments, the crankcase defines a lubricant sump containing a lubricant fluid.

In some embodiments, a motor driving the crankshaft is disposed within the discharge plenum. In some embodiments, the motor may be disposed outside of the discharge plenum and outside of the crankcase.

In another form, the present disclosure provides a compressor that may include a crankcase, a crankshaft, first and second pistons, first and second cylinders, first and second suction plenums and a first discharge passage. The crankcase defines an interior volume. The crankshaft is disposed within the crankcase. The first and second pistons are drivingly connected to the crankshaft by connecting rods extending from the interior volume into the cylinders. The first and second cylinders reciprocatingly receive the first and second pistons, respectively. The first piston and the first cylinder define a first compression chamber therebetween. The second piston and the second cylinder define a second compression chamber therebetween. The first suction plenum may be attached to the first cylinder. The first compression chamber draws working fluid from the first suction plenum. The first suction plenum includes a first inlet through which working fluid flows into the first suction plenum. Compressed working fluid flows through the first discharge passage from the first compression chamber to the interior volume of the crankcase. The second suction plenum may be attached to the second cylinder. The second compression chamber draws working fluid from the second suction plenum. The second suction plenum may include a second inlet through which working fluid flows into the second suction plenum from the interior volume of the crankcase.

In some embodiments, the second suction plenum includes a third inlet through which working fluid flows into the second suction plenum. The third inlet is fluidly isolated from the interior volume of the crankcase.

In some embodiments, the compressor includes a second discharge passage in fluid communication with the second compression chamber and through which compressed working fluid from the second compression chamber exits the compressor.

In some embodiments, the compressor includes a third discharge passage fluidly coupled to the interior volume of the crankcase and through which working fluid exits the compressor.

In some embodiments, the crankcase includes a fluid-injection inlet through which working fluid bypasses the first compression chamber.

In some embodiments, the compressor includes first, second and third valves. The first valve may control fluid flow into the first suction plenum through the first inlet. The second valve may control fluid flow into the second suction plenum through the second inlet. The third valve may control fluid flow into the second suction plenum through the third inlet.

In some embodiments, the crankcase includes a liquid-injection inlet through which liquid working fluid bypasses the first compression chamber.

In some embodiments, the crankcase includes a vapor-injection inlet through which vapor working fluid bypasses the first compression chamber.

In some embodiments, the compressor includes fourth and fifth valves. The fourth valve may control a flow of the vapor working fluid into the interior volume of the crankcase through the vapor-injection inlet. The fifth valve may control a flow of the liquid working fluid into the interior volume of the crankcase through the liquid-injection inlet.

In some embodiments, the compressor and/or a system in which the compressor is installed includes a control module operable to switch the compressor between first, second, third, fourth and fifth operating modes. The control module may open the first, second and fourth valves and close the third and fifth valves in the first operating mode. The control module may open the first, third and fifth valves and close the second and fourth valves in the second operating mode. The control module may open the first and fifth valves and close the second, third and fourth valves in the third operating mode. The control module may open the third and fifth valves and close the first, second and fourth valves in the fourth operating mode. The control module may open the fifth valve and close the first, second, third and fourth valves in the fifth operating mode.

In some embodiments, the first discharge passage extends through the first piston.

In some embodiments, a motor driving the crankshaft is disposed in the interior volume of the crankcase.

In another form, the present disclosure provides a method that may include operating a compressor in various operating modes. The compressor may include a crankcase, first and second cylinders, a crankshaft disposed within an interior volume of the crankcase. The first and second pistons are driven by the crankshaft and reciprocatingly received in the first and second cylinders, respectively. The first piston and the first cylinder define a first compression chamber therebetween. The second piston and the second cylinder define a second compression chamber therebetween. The compressor may include a first discharge passage through which compressed fluid flows from the first compression chamber to the interior volume of the crankcase. Operating the compressor in a first operating mode may include receiving working fluid in the first and second compression chambers and compressing working fluid in the first and second compression chambers. In a second operating mode, working fluid may be received in and compressed in one of the first and second compression chambers and working fluid may be restricted from flowing into another of the first and second compression chambers.

In some embodiments, in the first operating mode, the second compression chamber receives working fluid from the interior volume of the crankcase.

In some embodiments, the method includes operating the compressor in a third operating mode in which working fluid is received in and compressed in the first and second compression chambers and in which the second compression chamber is restricted from receiving working fluid from the interior volume of the crankcase.

In some embodiments, in the second operating mode, working fluid is received in and compressed in the second compression chamber and working fluid is restricted from flowing into the first compression chamber.

In some embodiments, in the second operating mode, working fluid is received in and compressed in the first compression chamber and working fluid is restricted from flowing into the second compression chamber.

In some embodiments, the method includes operating the compressor in a fourth operating mode in which working fluid is received in and compressed in the second compression chamber and working fluid is restricted from flowing into the first compression chamber.

In some embodiments, the method includes operating the compressor in a fifth operating mode in which a motor driving the crankshaft is operating and working fluid is restricted from flowing into both of the first and second compression chambers.

In some embodiments, operating the compressor in the first operating mode includes injecting intermediate-pressure working fluid into the interior volume of the crankcase. The intermediate-pressure working fluid may be at a pressure higher than a pressure of working fluid entering the first compression chamber and lower than a pressure of working fluid discharged from the second compression chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 2:
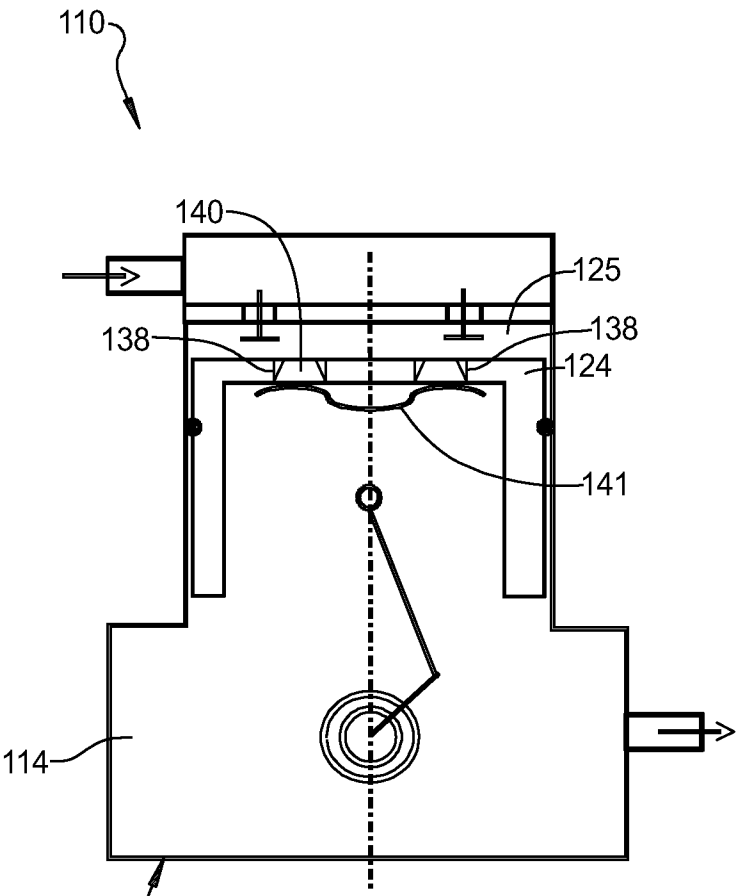
FIG. 2 is a schematic representation of another reciprocating compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
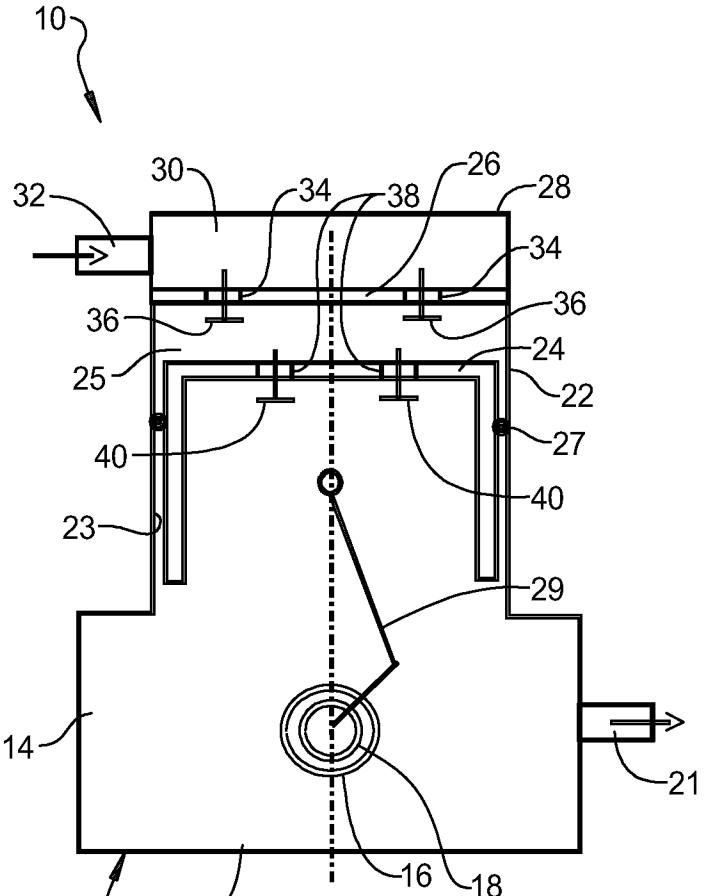
FIG. 1 is a schematic representation of a reciprocating compressor according to the principles of the present disclosure.
Figure 3:
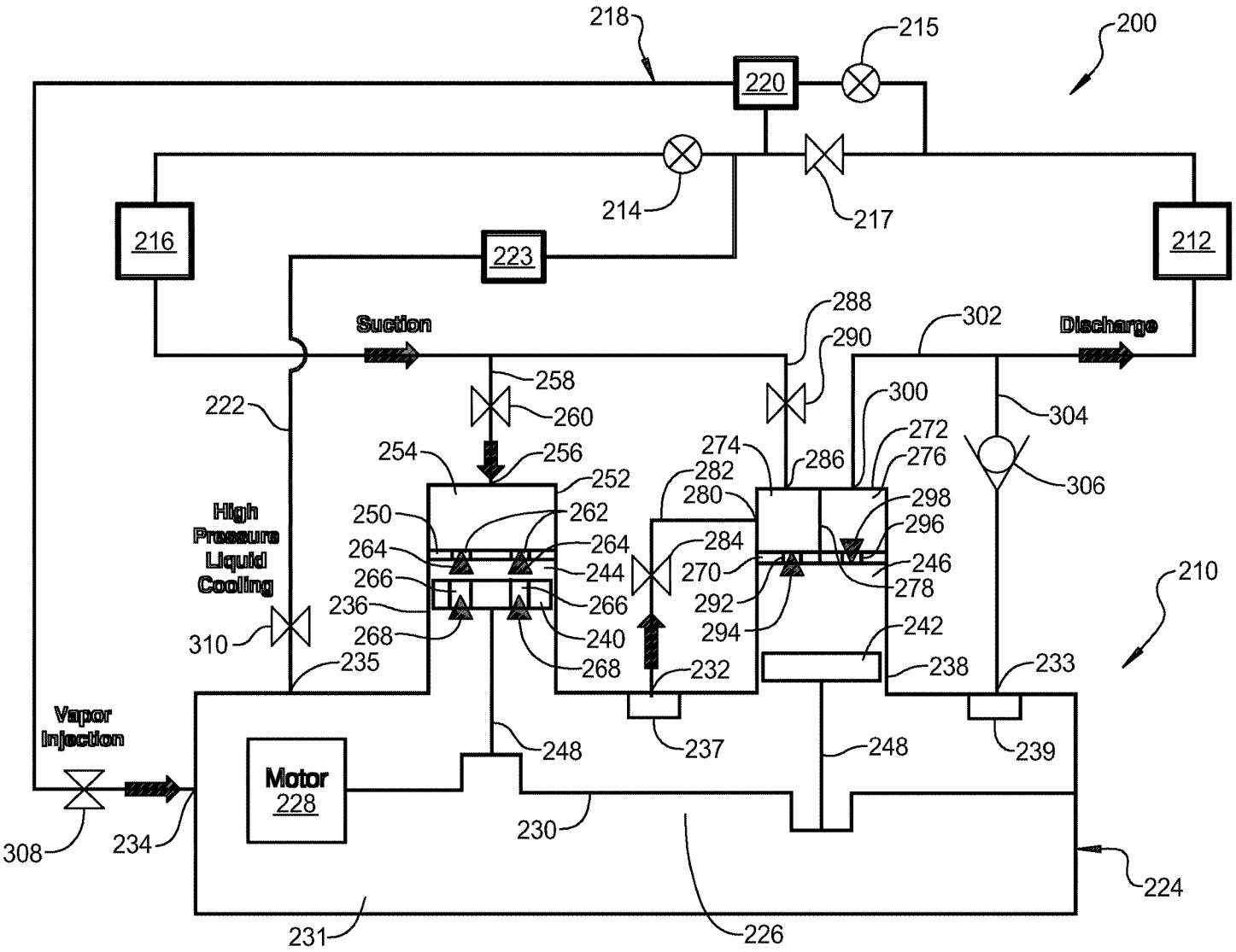
FIG. 3 is a schematic representation of a system having a reciprocating compressor operating in a first operating mode according to the principles of the present disclosure.
Figure 4:
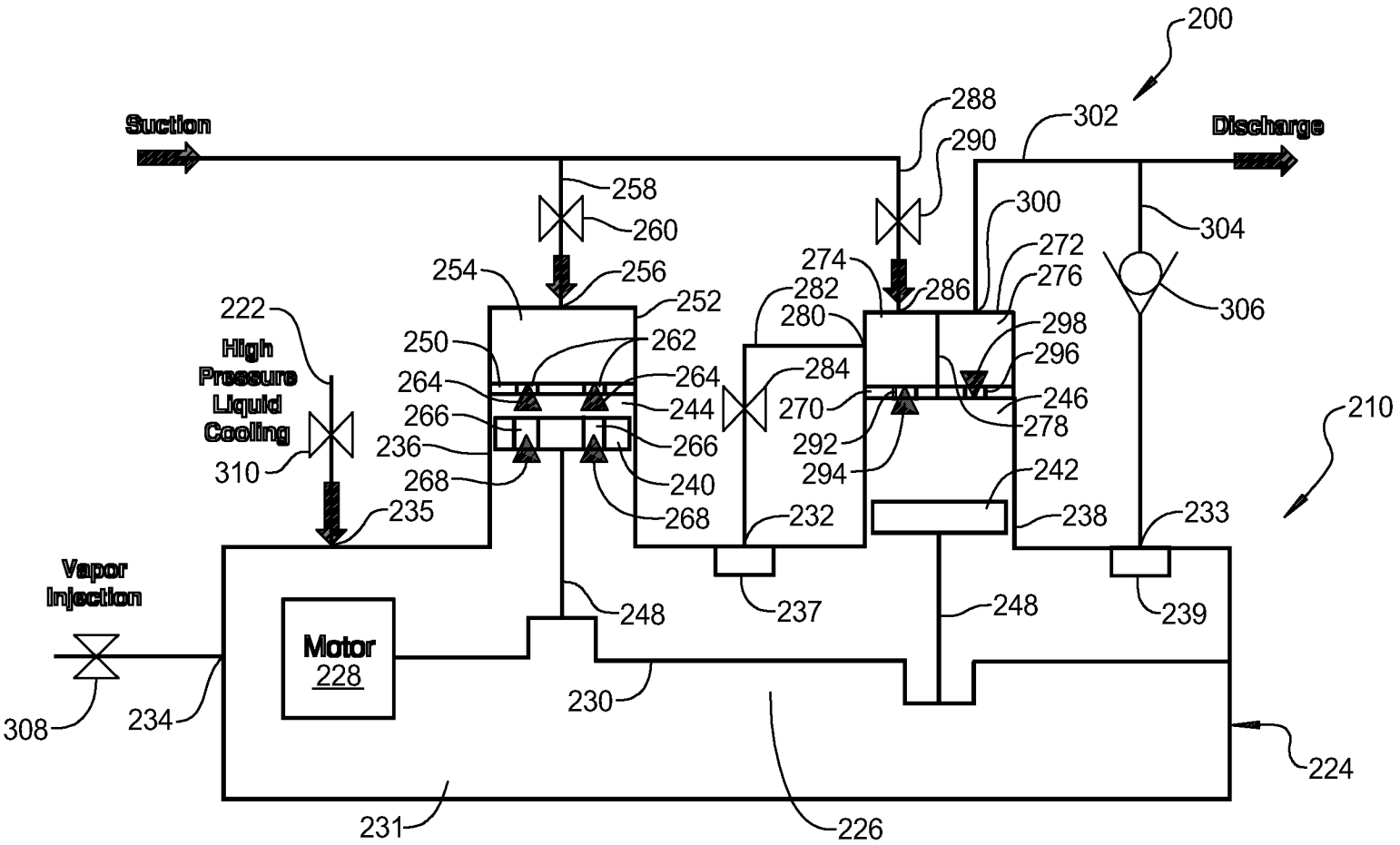
FIG. 4 is a schematic representation of the system operating in a second operating mode according to the principles of the present disclosure.
Figure 5:
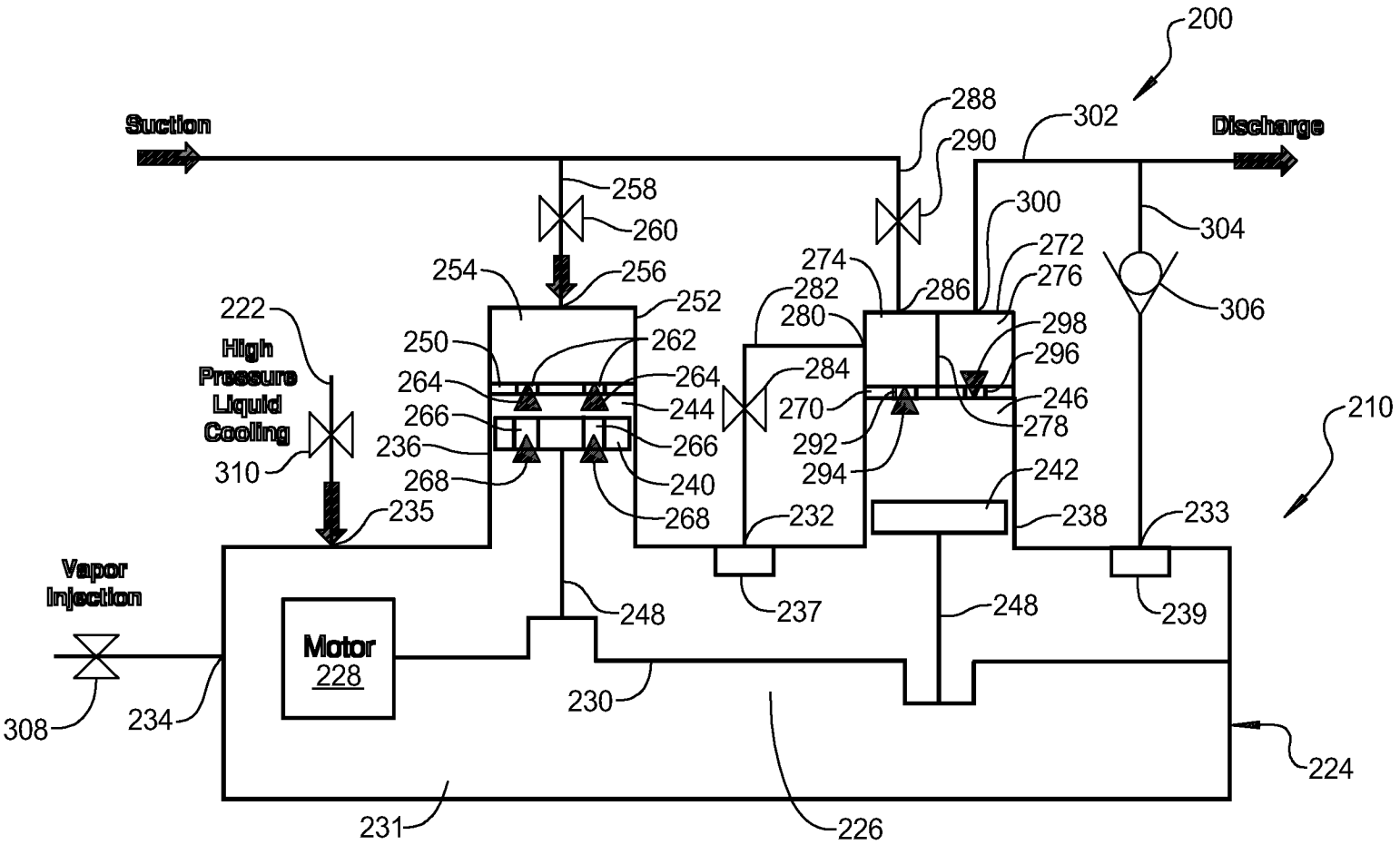
FIG. 5 is a schematic representation of the system operating in a third operating mode according to the principles of the present disclosure.
Figure 6:
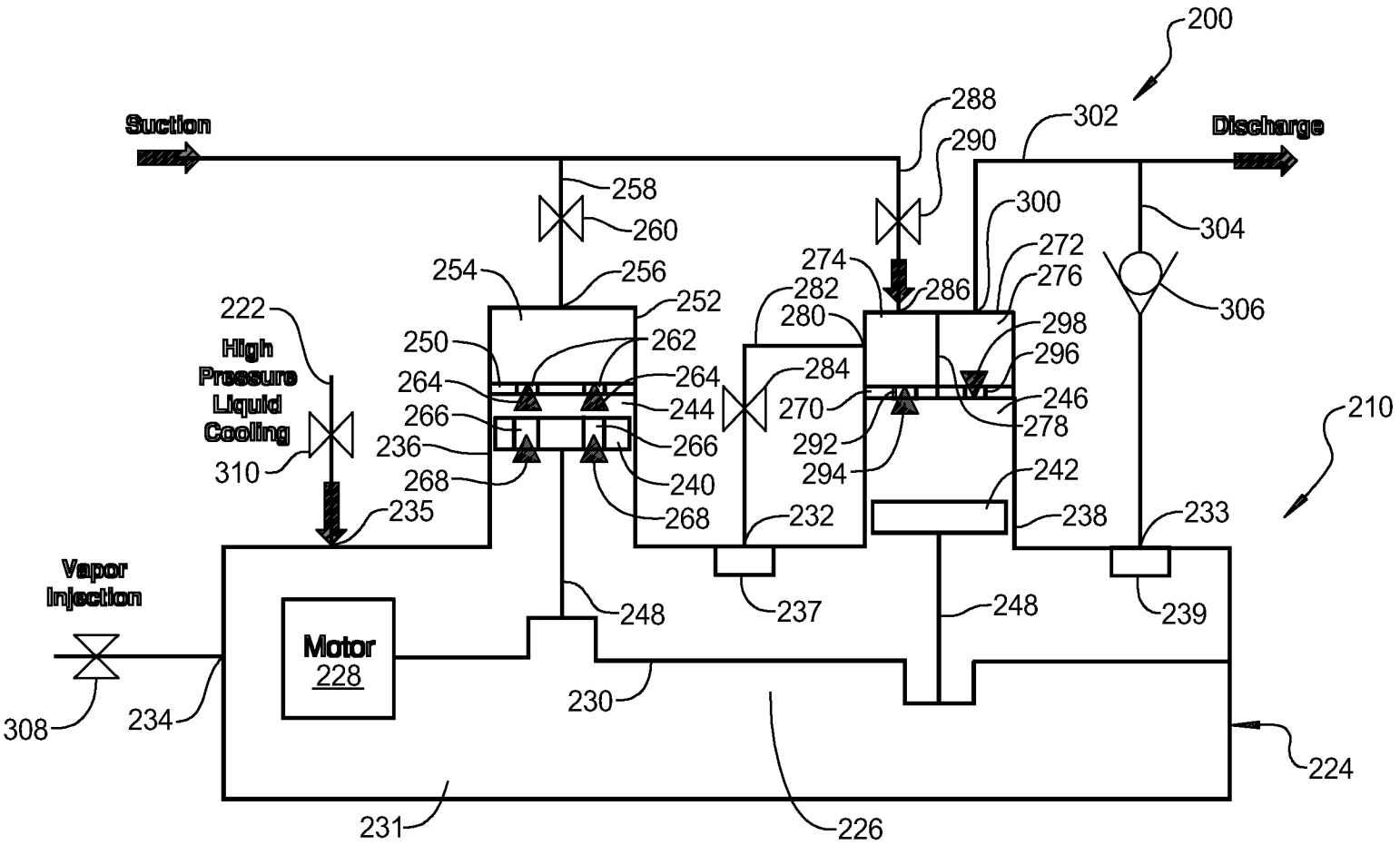
FIG. 6 is a schematic representation of the system operating in a fourth operating mode according to the principles of the present disclosure.
Figure 7:
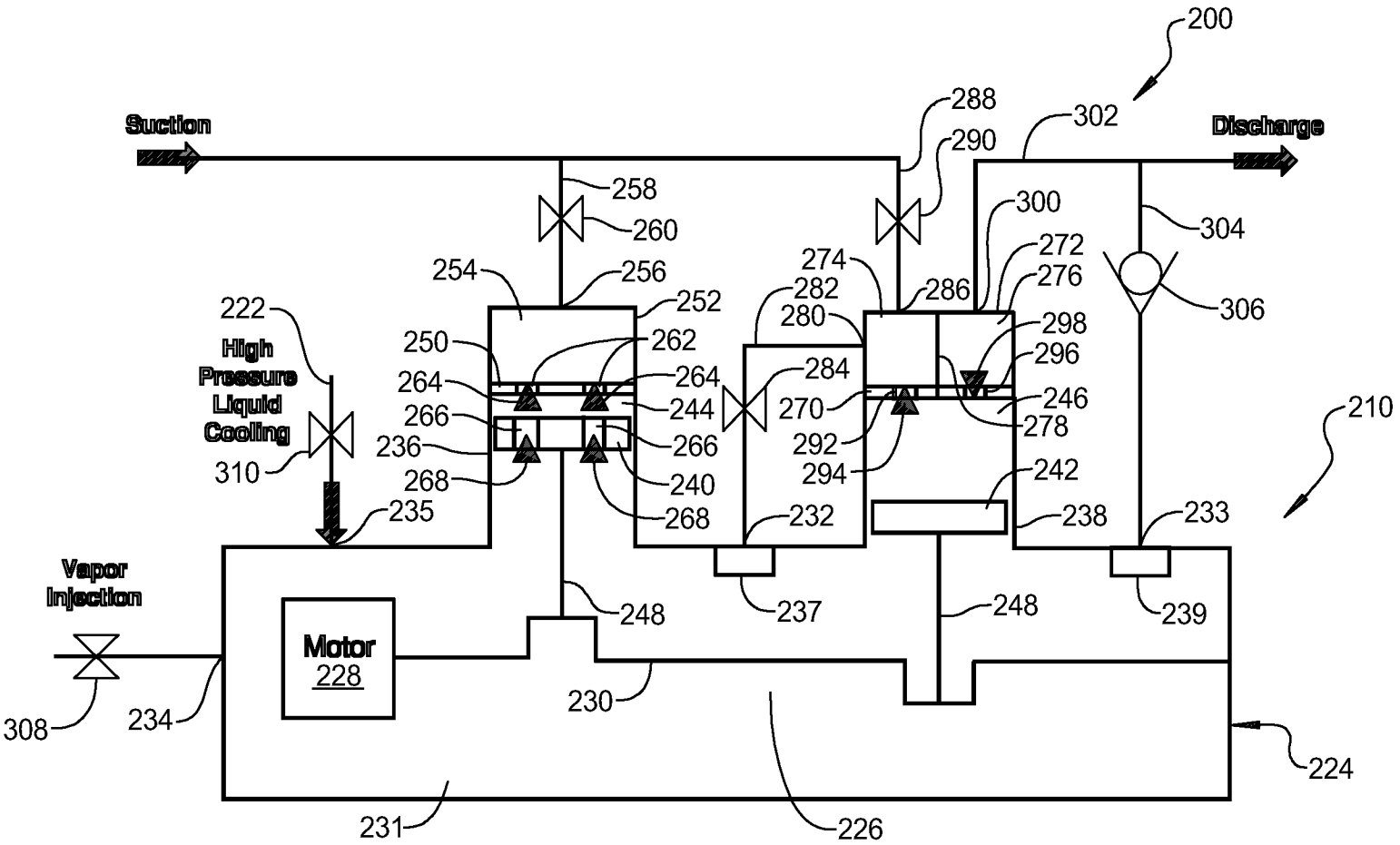
FIG. 7 is a schematic representation of the system operating in a fifth operating mode according to the principles of the present disclosure.
Figure 8:
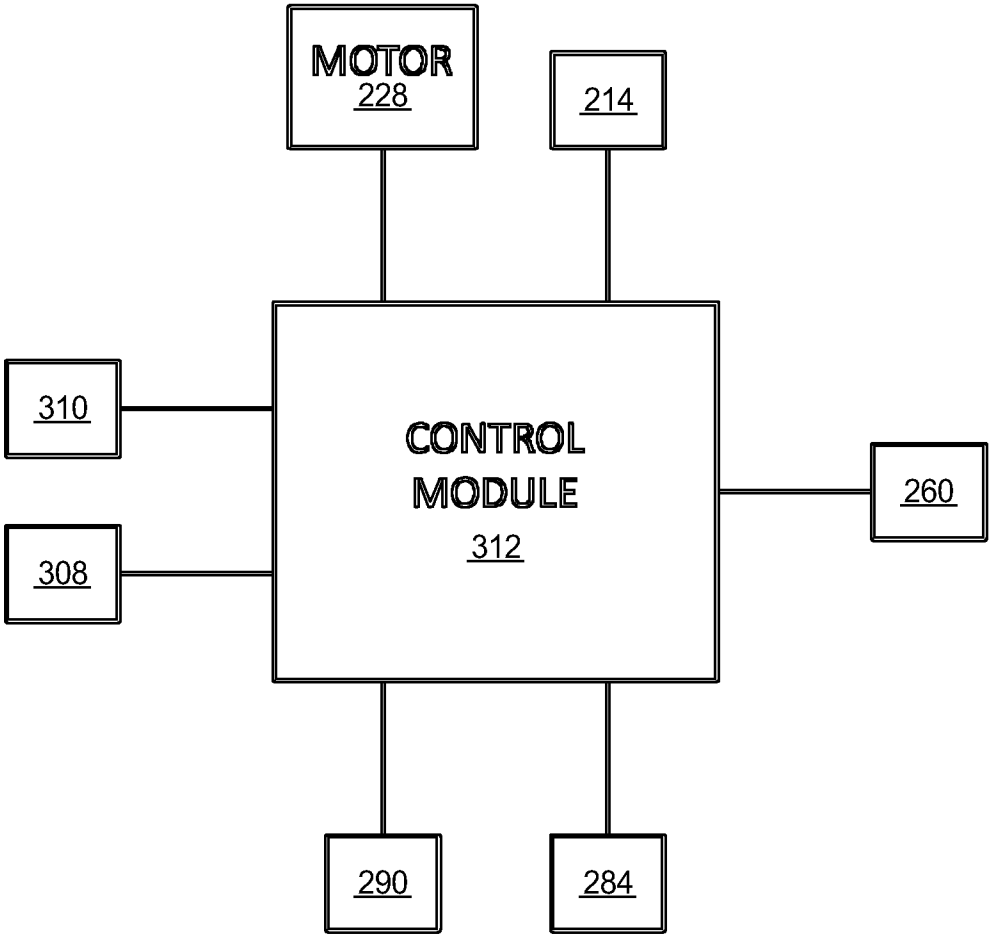
FIG. 8 is a schematic representation depicting a control module in communication with a motor and valves of the system.

With reference to FIG. 1, a compressor 10 is provided that may include a shell or crankcase 12 defining an interior volume 14 in which a motor 16 and a crankshaft 18 may be disposed. A portion of the interior volume 14 may define a lubricant sump 20. The crankcase 12 may include a discharge outlet 21 through which compressed working fluid may exit the compressor 10.

One or more cylinders 22 may extend from the crankcase 12. Each of the cylinders 22 slidably receives a piston 24. Each cylinder 22 and corresponding piston 24 define a compression chamber 25. Each piston 24 may include one or more piston rings 27 that provide a seal between the piston 24 and an inner diametrical surface 23 of the cylinder 22. Each piston 24 is drivingly connected to the crankshaft 18 by a connecting rod 29 so that rotation of the crankshaft 18 (driven by the motor 16) causes the piston 24 to reciprocate within the corresponding cylinder 22.

A cylinder head plate 26 may be mounted to an axial end of the one or more cylinders 22. A head cover 28 may be mounted to the cylinder head plate 26. The head cover 28 and cylinder head plate 26 cooperate to form a suction manifold or plenum 30 therebetween. The head cover 28 may include a suction inlet 32 through which low-pressure working fluid (from an evaporator, for example) may be drawn into the suction plenum 30.

The cylinder head plate 26 may include one or more suction passages 34 providing fluid communication between the suction plenum 30 and the one or more compression chambers 25. Suction valves 36 corresponding to each of the suction passages 34 may be mounted to the cylinder head plate 26. The suction valves 36 may be movable relative to the cylinder head plate 26 between open positions allowing fluid flow through the suction passages 34 and closed positions preventing fluid flow through the suction passages 34. The suction valves 36 can be reed valves and/or spring-biased valves that allow fluid to flow from the suction plenum 30 to the compression chamber 25 during at least a portion of an intake stroke of the piston 24 (i.e., when the piston 24 is moving away from the cylinder head plate 26) and prevent fluid flow from the compression chamber 25 to the suction plenum 30.

Each piston 24 may include one or more discharge passages 38 extending therethrough to provide fluid communication between the compression chamber 25 and the interior volume 14 of the crankcase 12. Discharge valves 40 corresponding to each of the discharge passages 38 may be mounted to the piston 24. The discharge valves 40 may be movable relative to the piston 24 between open positions allowing fluid flow through the discharge passages 38 and closed positions preventing fluid flow through the discharge passages 38. The discharge valves 40 can be reed valves and/or spring-biased valves that allow fluid to flow through the discharge passages 38 from the compression chamber 25 to the interior volume 14 of the crankcase 12 during at least a portion of a compression stroke of the piston 24 (i.e., when the piston 24 is moving toward the cylinder head plate 26) and prevent fluid flow through the discharge passages 38 from the interior volume 14 to the compression chamber 25.

With continued reference to FIG. 1, operation of the compressor 10 will be described. Operation of the motor 16 causes rotation of the crankshaft 18 relative to the crankcase 12. Such rotation of the crankshaft 18 causes the piston 24 to reciprocate within the cylinder 22. As described above, movement of the piston 24 away from the cylinder head plate 26 causes the suction valves 36 to open to allow low-pressure working fluid in the suction plenum 30 to be drawn into the compression chamber 25 through the suction passages 34. At or near a bottom of the intake stroke of the piston 24 (i.e., at or near bottom-dead-center), a fluid pressure within the compression chamber 25 will equalize or nearly equalize with a fluid pressure within the suction plenum 30, thereby causing the suction valves 36 to close to prevent fluid flow through the suction passages 34.

Thereafter, as the piston 24 moves toward the cylinder head plate 26, the working fluid within the compression chamber 25 is compressed to a higher pressure and the discharge valves 40 are forced open to allow the compressed working fluid to flow through the discharge passages 38 into the interior volume 14 of the crankcase 12 before exiting the compressor 10 through the discharge outlet 21. In this manner, the interior volume 14 acts as a discharge plenum containing compressed working fluid. That is, the interior volume 14 of the crankcase 12 is the high side of the compressor 10.

Using the interior volume 14 of the crankcase 12 as the high side of the compressor 10 provides several advantages. For example, a discharge temperature of the working fluid (i.e., a temperature of the working fluid exiting the compressor 10) is reduced because the low-pressure (e.g., suction pressure) working fluid is not preheated by exposure to the heat of the motor 16. Reducing the discharge temperature of the working fluid increases the efficiency of the compressor 10 and the system in which the compressor 10 is installed. Reducing discharge temperature is especially advantageous in systems using high heat-of-compression working fluids, such as R32, $NH_3$ and $CO_2$, for example.

Furthermore, the interior volume 14 of the crankcase 12 can function as a discharge muffler and an oil separator. Oil may be separated from the compressed working fluid in the interior volume 14 (e.g., oil droplets may impinge on surfaces of various components within the crankcase 12 and drip down to the lubricant sump 20) before the working fluid exits the compressor 10 through the discharge outlet 21. In some configurations, a dedicated oil separator (not shown) could be disposed within the crankcase 12 or outside of the compressor 10. In some configurations, cooling liquid (e.g., oil or liquid working fluid from a source of intermediate-pressure working fluid (not shown)) may be injected into the crankcase 12 through a liquid-injection opening (not shown) to cool the motor 16 and lubricant in the lubricant sump 20.

Providing the discharge passages 38 and discharge valves 40 on the piston 24 and providing only the suction passages 34 in the cylinder head plate 26 also provides several advantages. For example, separating the cylinder head plate 26 from the discharge plenum reduces preheating of the low-pressure working fluid in the suction plenum 30 (thereby reducing the discharge temperature). Furthermore, the arrangement described above provides more packaging space for suction passages and suction valves to improve the flow of low-pressure fluid into the compression chamber 25 during the intake stroke. Furthermore, having the discharge valves 40 on the piston 24 allows for the inertia of the piston 24 to help close the discharge valves 40 at or near top-dead-center (i.e., the end of the compression stroke).

In some configurations, one or more discharge passages 38 could extend through a piston rod connecting the piston 24 with the connecting rod 29. In some configurations, the piston-cylinder assembly could be a double-acting piston-cylinder assembly.

FIG. 2 depicts another compressor 110 that can be identical to the compressor 10, apart for the exceptions described below and shown in the figures. Therefore, similar structures and functions will not be described again. The compressor 110 includes an annular discharge valve ring 140 (instead of the discharge valves 40 described above) mounted to a piston 124. The discharge valve ring 140 may selectively open and close one or more discharge passages 138 that extend through the piston 124. A spring 141 (such as a wave ring or a coil spring, for example) may bias the discharge valve ring 140 toward the closed position to allow compressed working fluid to flow from compression chamber 125 to an interior volume 114 of crankcase 112 and prevent fluid flow from the interior volume 114 to the compression chamber 125.

With reference to FIGS. 3-8, a system 200 is provided that may include a compressor 210, a first heat exchanger 212, an expansion device 214 and a second heat exchanger 216. The first heat exchanger 212 may receive working fluid discharged from the compressor 210 and reject heat from the working fluid to the ambient air, for example, or some other fluid. From the first heat exchanger 212, some or all of the working fluid can flow either through the expansion device 214 and, in some operating modes, some of the working fluid can flow through a vapor-injection circuit 218 including another expansion device 215 and a flash tank 220 (or another heat exchanger) to be injected into the compressor 210 (as will be described in more detail below). Some or all of the expanded working fluid from the expansion device 214 may flow to the second heat exchanger 216 in which the working fluid may absorb heat from a space to be cooled by the system 200. In some operating modes, a pump 223 may pump some of the working fluid from the first heat exchanger 212 through a liquid-injection line 222 to be injected into the compressor 210 (as will be described in more detail below). From the second heat exchanger 216, the working fluid may flow back to the compressor 210 to repeat the process described above.

In some configurations, a valve 217 may be disposed upstream of the expansion device 214 and may control an amount of fluid flow into the vapor-injection line 218 and an amount of fluid that is allowed to flow toward liquid-injection line 222 and the expansion device 214.

In some configurations, all of the working fluid from the first heat exchanger 212 may flow through the expansion device 215 and the flash tank 220 before either flowing into the vapor-injection line 218, toward the expansion device 214 and second heat exchanger 216, or into the liquid-injection line 222.

In some configurations, the system 200 may not include the vapor-injection circuit 218. In such configurations, working fluid from the first heat exchanger 212 can flow through the liquid-injection line 222 or through the expansion device 214 and the second heat exchanger 216.

The system 200 described above and shown in the figures could be a refrigeration system or an air conditioning system, for example. In some configurations, however, the system 200 could be configured as a reversible heat-pump system that is operable in a cooling mode and in a heating mode.

The compressor 210 may include a shell or crankcase 224 defining an interior volume 226 in which a motor 228 and a crankshaft 230 may be disposed. A portion of the interior volume 226 may define a lubricant sump 231. The crankcase 224 may include first and second discharge outlets 232, 233 and first and second inlets 234, 235. First and second oil separators 237, 239 may be disposed within interior volume 226 of the crankcase 224 at or near the first and second discharge outlets 232, 233, respectively. The first inlet 234 may be fluidly coupled with the vapor-injection circuit 218 and may allow working fluid therefrom to enter to the interior volume 226 of the crankcase 224. The second inlet 235 may be fluidly coupled with the liquid-injection line 222 and may allow working fluid therefrom to enter to the interior volume 226 of the crankcase 224.

First and second cylinders 236, 238 may extend from the crankcase 224. The first and second cylinders 236, 238 slidably receive first and second pistons 240, 242, respectively. The first cylinder 236 and first piston 240 define a first compression chamber 244. The second cylinder 238 and second piston 242 define a second compression chamber 246. While not shown in the figures, each piston 240, 242 may include one or more piston rings that provide a seal between outer diametrical surfaces of the pistons 240, 242 and inner diametrical surfaces of the cylinders 236, 238. The pistons 240, 242 are drivingly connected to the crankshaft 230 by connecting rods 248 so that rotation of the crankshaft 230 (driven by the motor 228) causes the pistons 240, 242 to reciprocate within the corresponding cylinders 236, 238.

A first cylinder head plate 250 may be mounted to an axial end of the first cylinder 236. A first head cover 252 may be mounted to the first cylinder head plate 250. The first head cover 252 and first cylinder head plate 250 cooperate to form a first suction manifold or plenum 254 therebetween. The first head cover 252 may include a first suction inlet 256 fluidly coupled with a first suction inlet line 258 through which low-pressure working fluid (e.g., from the second heat exchanger 216) may be drawn into the first suction plenum 254. The first suction inlet line 258 may include a first valve 260 (a solenoid valve, for example) that can be opened and closed to control a flow of working fluid into the first suction plenum 254.

The first cylinder head plate 250 may include one or more suction passages 262 providing fluid communication between the first suction plenum 254 and the first compression chamber 244. Suction valves 264 corresponding to each of the suction passages 262 may be mounted to the first cylinder head plate 250. The suction valves 264 may be movable relative to the first cylinder head plate 250 between open positions allowing fluid flow through the suction passages 262 and closed positions preventing fluid flow through the suction passages 262. The suction valves 264 can be reed valves and/or spring-biased valves that allow fluid to flow from the first suction plenum 254 to the first compression chamber 244 during at least a portion of an intake stroke of the first piston 240 and prevent fluid flow from the first compression chamber 244 to the first suction plenum 254.

The first piston 240 may include one or more discharge passages 266 extending therethrough to provide fluid communication between the first compression chamber 244 and the interior volume 226 of the crankcase 224. Discharge valves 268 corresponding to each of the discharge passages 266 may be mounted to the first piston 240. The discharge valves 268 may be movable relative to the first piston 240 between open positions allowing fluid flow through the discharge passages 266 and closed positions preventing fluid flow through the discharge passages 266. The discharge valves 268 can be reed valves and/or spring-biased valves that allow fluid to flow through the discharge passages 266 from the first compression chamber 244 to the interior volume 226 of the crankcase 224 during at least a portion of a compression stroke of the first piston 240 and prevent fluid flow through the discharge passages 266 from the interior volume 226 to the first compression chamber 244.

A second cylinder head plate 270 may be mounted to an axial end of the second cylinder 238. A second head cover 272 may be mounted to the second cylinder head plate 270. The second head cover 272 and second cylinder head plate 270 cooperate to form a second suction manifold or plenum 274 and a discharge plenum 276. The second head cover 272 includes a partition 278 that separates the second suction plenum 274 from the discharge plenum 276. The second head cover 272 may include a second suction inlet 280 in fluid communication with the first outlet 232 of the crankcase 224 via a conduit 282. A second valve 284 (a solenoid valve, for example) can be opened and closed to control a flow of working fluid from the interior volume 226 of the crankcase 224 to the second suction plenum 274. The second head cover 272 may also include a third suction inlet 286 fluidly coupled with a second suction inlet line 288 through which low-pressure working fluid (e.g., from the second heat exchanger 216) may be drawn into the second suction plenum 274. The second suction inlet line 288 may include a third valve 290 (a solenoid valve, for example) that can be opened and closed to control a flow of working fluid into the second suction plenum 274.

The second cylinder head plate 270 may include one or more suction passages 292 providing fluid communication between the second suction plenum 274 and the second compression chamber 246. Suction valves 294 corresponding to each of the suction passages 292 may be mounted to the second cylinder head plate 270. The suction valves 294 may be movable relative to the second cylinder head plate 270 between open positions allowing fluid flow through the suction passages 292 and closed positions preventing fluid flow through the suction passages 292. The suction valves 294 can be reed valves and/or spring-biased valves that allow fluid to flow from the second suction plenum 274 to the second compression chamber 246 during at least a portion of an intake stroke of the second piston 242 and prevent fluid flow from the second compression chamber 246 to the second suction plenum 274.

The second cylinder head plate 270 may also include one or more discharge passages 296 providing fluid communication between the second compression chamber 246 and the discharge plenum 276. Discharge valves 298 corresponding to each of the discharge passages 296 may be mounted to the second cylinder head plate 270. The discharge valves 298 may be movable relative to the second cylinder head plate 270 between open positions allowing fluid flow through the discharge passages 296 and closed positions preventing fluid flow through the discharge passages 296. The discharge valves 298 can be reed valves and/or spring-biased valves that allow fluid to flow from the second compression chamber 246 to the discharge plenum 276 during at least a portion of a compression stroke of the second piston 242 and prevent fluid flow from the discharge plenum 276 to the second compression chamber 246.

The second head cover 272 may include an outlet 300 fluidly coupled with a discharge conduit 302 that may provide compressed working fluid to the first heat exchanger 212. The discharge conduit 302 may also be fluidly connected with the second outlet 233 of the crankcase 224 via conduit 304. The conduit 304 may include a one-way valve 306 that allows fluid flow from the second outlet 233 to the discharge conduit 302 but prevents fluid flow from the discharge conduit 302 to the second outlet 233.

The vapor-injection circuit 218 may include a fourth valve 308 (a solenoid valve, for example) between the flash tank 220 (or heat exchanger) and the first inlet 234 that may open and close to control fluid flow from the vapor-injection circuit 218 to the interior volume 226 of the crankcase 224. The liquid-injection line 222 may include a fifth valve 310 (a solenoid valve, for example) that may open and close to control fluid flow from the liquid-injection line 222 to the interior volume 226 of the crankcase 224. A control module 312 (FIG. 8) may be in communication with and control operation of the first, second, third, fourth and fifth valves 260, 284, 290, 308, 310, the expansion device 214, and the motor 228.

With continued reference to FIGS. 3-8, operation of the system 200 will be described. The control module 312 may control operation of the compressor 210 and the system 200 and switch the compressor 210 and system 200 between first, second, third, fourth and fifth operating modes to optimize performance of the system 200 over a large operational envelope that may be desirable for a cooling system for transporting and/or storing food products or other items, for example. It will be appreciated that the operating modes could also be advantageously employed in air conditioning and/or heating systems. The control module 312 may switch between the various operating modes based on a cooling demand, a desired capacity level, and/or a particular application for which the system 200 is employed.

In the first operating mode (shown in FIG. 3), the compressor 210 may operate as a two-stage compressor with vapor-injection to provide a high capacity output for use in transporting and/or storing frozen food, for example. In the first operating mode, the control module 312 may open the first, second and fourth valves 260, 284, 308 and close the third and fifth valves 290, 310. With the valves positioned in this manner, low-pressure working fluid from the second heat exchanger 216 can flow into the first suction plenum 254 through the first suction inlet 256 and is prevented from flowing into the second suction plenum 274 through the third suction inlet 286. Working fluid in the first suction plenum 254 is drawn into the first compression chamber 244 through suction passages 262 and is compressed therein by the first piston 240 to a first discharge pressure. As described above, during at least a portion of the compression stroke of the first piston 240, the discharge valves 268 will be open, thereby allowing compressed working fluid to flow through the discharge passages 266 and into the interior volume 226 of the crankcase 224. In this manner, the interior volume 226 acts as a discharge plenum and muffler.

Intermediate-pressure working fluid from the vapor-injection circuit 218 (e.g., working fluid at a pressure greater than a pressure of working fluid exiting the second heat exchanger 216, but less than a pressure of working fluid entering the first heat exchanger 212) also enters the interior volume 226 through the first inlet 234. Working fluid in the interior volume 226 can flow through the first oil separator 237, where oil can be removed from the working fluid and returned to the lubricant sump 231. From the first oil separator 237, the working fluid may flow through the conduit 282 and into the second suction plenum 274 through the second suction inlet 280. From the second suction plenum 274, the working fluid is drawn into the second compression chamber 246 and is further compressed by the second piston 242 to a second discharge pressure that is higher than the first discharge pressure of the working fluid in the interior volume. During at least a portion of the compression stroke of the second piston 242, the discharge valves 298 will be open, thereby allowing compressed working fluid to flow through the discharge passages 296 and into the discharge plenum 276. From the discharge plenum 276, the working fluid may exit the compressor 210 through the outlet 300 and flow back toward the first heat exchanger 212 through the discharge conduit 302.

It will be appreciated that the control module 312 could, depending on capacity demand and operating conditions, selectively close or modulate the fourth valve 308 to disable or modulate the vapor injection.

In the second operating mode (shown in FIG. 4), the two piston-cylinder assemblies 240, 236, 242, 238 may operate in parallel to provide a relatively high capacity output (which may be a lower capacity output than the first operating mode) for use in a pull-down cycle for fresh or frozen food, for example. In the second operating mode, the control module 312 may open the first, third and fifth valves 260, 290, 310 and close the second and fourth valves 284, 308. With the valves positioned in this manner, low-pressure working fluid from the second heat exchanger 216 may be drawn into the first and second suction plenums 254, 274 through the first and second suction inlet lines 258, 288. The second valve 284 is closed to prevent fluid communication between the interior volume 226 and the second suction plenum 274.

Working fluid is compressed in both of the first and second compression chambers 244, 246. Compressed working fluid in the first compression chamber 244 is discharged into the interior volume 226, and compressed working fluid in the second compression chamber 246 is discharged into the discharge plenum 276, as described above. From the discharge plenum 276, the compressed working fluid may flow through the outlet 300 and into the discharge conduit 302. The working fluid compressed in the first compression chamber 244 may flow from the interior volume 226, through the second oil separator 239 and exit the compressor through the second outlet 233. From the second outlet 233, the working fluid flows through the one-way valve 306 to the discharge conduit 302 and then to the first heat exchanger 212.

Because the fifth valve 310 is open in the second operating mode, intermediate-pressure or high-pressure liquid from the liquid-injection line 222 may flow into the interior volume 226 to cool the motor 228. In the interior volume, the working fluid from the liquid-injection line 222 mixes with compressed working fluid from the first compression chamber 244 and exits the compressor through the second outlet 233, as described above.

In the third operating mode (shown in FIG. 5), the first piston-cylinder assemblies 240, 236 may operate while the second piston-cylinder assembly 242, 238 is disabled. Such a configuration may provide a capacity output that is lower than the first and second operating modes, but higher than the fourth and fifth operating modes. The third operating mode may be advantageously used in a refrigeration cycle for fresh food, for example. In the third operating mode, the control module 312 may open the first and fifth valves 260, 310 and close the second, third and fourth valves 284, 290, 308. With the valves positioned in this manner, low-pressure working fluid from the second heat exchanger 216 may be drawn into the first suction plenum 254 through the first suction inlet line 258. The second valve 284 is closed to prevent fluid communication between the interior volume 226 and the second suction plenum 274, and the third valve 290 is closed to prevent fluid communication between the second suction plenum 274 and the second suction inlet line 288. Accordingly, working fluid is compressed in the first compression chamber 244 and compression of working fluid may be substantially disabled in the second compression chamber 246.

As described above, high-pressure or intermediate-pressure working fluid from the liquid-injection line 222 may enter the interior volume 226 through the second inlet 235, and working fluid from the first compression chamber 244 is discharged into the interior volume 226. From the interior volume 226, the working fluid flows through the second oil separator 239, through the conduit 304 and toward the first heat exchanger 212.

In the fourth operating mode (shown in FIG. 6), the second piston-cylinder assemblies 242, 238 may operate while the first piston-cylinder assembly 240, 236 is disabled. Such a configuration may provide a capacity output that is lower than the first, second and third operating modes, but higher than the fifth operating mode. The fourth operating mode may be advantageously used in a refrigeration cycle for fresh food, for example. In the fourth operating mode, the control module 312 may open the third and fifth valves 290, 310 and close the first, second, and fourth valves 260, 284, 308. With the valves positioned in this manner, low-pressure working fluid from the second heat exchanger 216 may be drawn into the second suction plenum 274 through the second suction inlet line 288 and the third suction inlet 286. The second valve 284 is closed to prevent fluid communication between the interior volume 226 and the second suction plenum 274, and the first valve 260 is closed to prevent fluid communication between the first suction plenum 254 and the first suction inlet line 258. Accordingly, working fluid is compressed in the second compression chamber 246 and compression of working fluid may be substantially disabled in the first compression chamber 244.

As described above, high-pressure or intermediate-pressure working fluid from the liquid-injection line 222 may enter the interior volume 226 through the second inlet 235 to cool the motor 228. From the interior volume 226, the working fluid flows through the second oil separator 239, through the conduit 304 and toward the first heat exchanger 212. Meanwhile, low-pressure working fluid is compressed in the second compression chamber 246 and discharged to the discharge plenum 276, as described above. From the discharge plenum 276, the compressed working fluid may flow into the discharge conduit 302 and flow toward the first heat exchanger 212.

In the fifth operating mode (shown in FIG. 7), both of the first and second piston-cylinder assemblies 240, 236, 242, 238 may be disabled to digitally unload the compressor 210. The control module 312 may modulate operation of the compressor 210 between the fifth operating mode and any of the first, second, third and fourth operating modes to provide a desired capacity level. Such operation may be advantageously used in a refrigeration cycle for fresh food, for example. In the fifth operating mode, the control module 312 may open the fifth valve 310 and close the first, second, third and fourth valves 260, 284, 290, 308. Accordingly, with the valves in this configuration, liquid working fluid from the liquid-injection line 222 may continue to flow into the interior volume 226 to cool the motor 228 and exit the compressor 210 through the second outlet 233, as described above. It will be appreciated that even though compression of working fluid in both of the first and second piston-cylinder assemblies 240, 236, 242, 238 may be disabled in the fifth operating mode, in some configurations, the motor 228 may continue to operate in the fifth operating mode and may continue to rotate the crankshaft 230.

While the compressor 210 is described above and depicted as having two cylinders and two pistons, it will be appreciated that the compressor 210 could have any number of pistons and cylinders. Furthermore, in some configurations, the compressor 210 could incorporate a double-acting piston-cylinder assembly.

Figure 9:
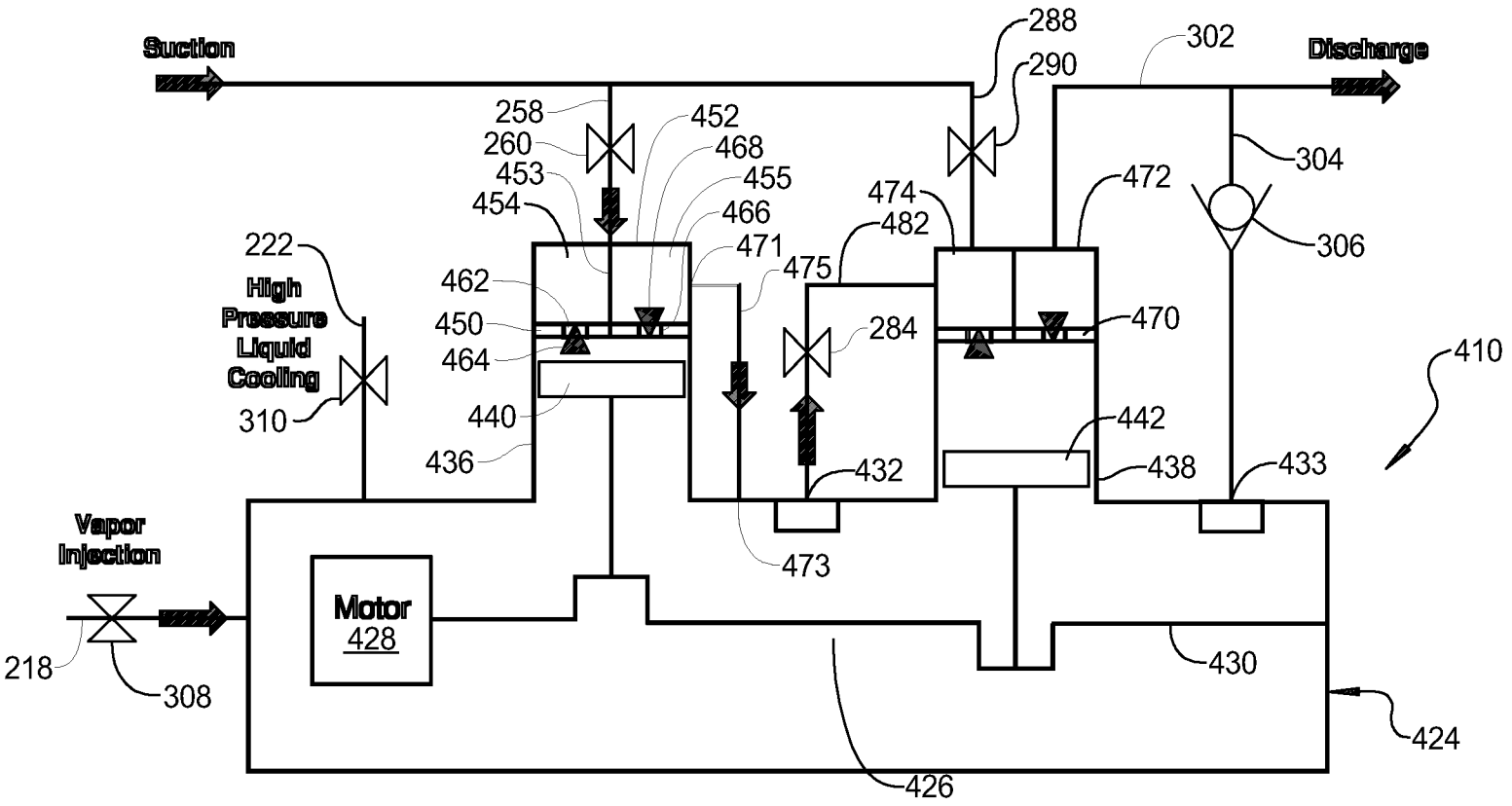
FIG. 9 is a schematic representation of another system having another reciprocating compressor according to the principles of the present disclosure.

With reference to FIG. 9, another compressor 410 is provided that may be incorporated into the system 200 instead of the compressor 210. The structure and function of the compressor 410 may be similar or identical to that of the compressor 210 described above, apart from any exceptions described herein and/or shown in the figures. Therefore, similar features will not be described again in detail.

The compressor 410 may include a crankcase 424 defining an interior volume 426 in which a motor 428 and a crankshaft 430 may be disposed. The crankshaft 430 drives first and second pistons 440, 442, which reciprocate within first and second cylinders 436, 438. A first cylinder head plate 450 and a first head cover 452 may be attached to an axial end of the first cylinder 436. A second cylinder head plate 470 and a second head cover 472 may be attached to an axial end of the second cylinder 438. The second piston 442, second cylinder head plate 470 and second head cover 472 may be substantially identical to the second piston 242, second cylinder head plate 270 and second head cover 272 described above.

The first cylinder head plate 450 may be similar or identical to the second cylinder head plate 470. That is, the first cylinder head plate 450 may include one or more suction passages 462, one or more suction valves 464, one or more discharge passages 466 and one or more discharge valves 468. The first head cover 452 may include a partition 453. The first head cover 452 cooperates with the first cylinder head plate 450 to define a suction plenum 454 and a discharge plenum 455. The partition 453 separates the suction plenum 454 from the discharge plenum 455. The first head cover 452 includes a discharge outlet 471. The crankcase 424 includes an inlet 473 that is fluidly connected to the discharge outlet 471 by a conduit 475.

The compressor 410 is operable in the first, second, third, fourth and fifth operating modes described above. During operation of the compressor 410 in the first, second and third operating modes, working fluid compressed by the first piston 440 may flow through the discharge passage 466, into the discharge plenum 455, through the discharge outlet 471 and into the interior volume 426 of the crankshaft 424 through the conduit 475 and inlet 473. From the interior volume 426, the working fluid may flow through outlet 432 and into a second suction plenum 474 of the second piston-cylinder assembly 442, 438 through conduit 482 or the working fluid may flow through the outlet 433 and into the discharge conduit 302 through the conduit 304.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A compressor for compressing a working fluid, said compressor comprising a crankcase defining an interior volume;

a crankshaft disposed within said crankcase;

a first piston connected to said crankshaft;

a second piston connected to said crankshaft;

a first cylinder receiving said first piston, said first piston and said first cylinder defining a first compression chamber;

a second cylinder receiving said second piston, said second piston and said second cylinder defining a second compression chamber;

a first suction plenum in selective fluid communication with said first compression chamber, said first compression chamber drawing said working fluid from said first plenum, said first suction plenum including a first inlet through which working fluid flows into said first suction plenum;

a first discharge passage through which compressed working fluid from said first compression chamber flows to said interior volume of said crankcase; and a second suction plenum in selective fluid communication with said second compression chamber, said second compression chamber drawing working fluid from said second suction plenum, said second suction plenum including a second inlet through which working fluid flows into said second suction plenum from said interior volume of said crankcase, wherein said second suction plenum includes a third inlet through which working fluid flows into said second suction plenum, wherein said third inlet is fluidly isolated from said interior volume of said crankcase.

2. The compressor of claim 1, further comprising a second discharge passage receiving working fluid from said second compression chamber and through which compressed working fluid from said second compression chamber exits the compressor.

3. The compressor of claim 2, further comprising a third discharge passage fluidly coupled to said interior volume of said crankcase and through which working fluid exits the compressor.

4. The compressor of claim 1, wherein said crankcase includes a fluid-injection inlet through which working fluid bypasses said first compression chamber.

5. The compressor of claim 1, further comprising:

a first valve controlling fluid flow into said first suction plenum through said first inlet;

a second valve controlling fluid flow into said second suction plenum through said second inlet; and a third valve controlling fluid flow into said second suction plenum through said third inlet.

6. The compressor of claim 5, wherein said crankcase includes a liquid-injection inlet through which a liquid component of said working fluid bypasses said first compression chamber, and wherein said crankcase includes a vapor-injection inlet through which a vapor component of said working fluid bypasses said first compression chamber.

7. The compressor of claim 6, further comprising a fourth valve controlling a flow of said vapor component of said working fluid into said interior volume of said crankcase through said vapor-injection inlet.

8. The compressor of claim 7, further comprising a fifth valve controlling a flow of said liquid component of said working fluid into said interior volume of said crankcase through said liquid-injection inlet.

9. The compressor of claim 8, further comprising a control module operable to switch the compressor between first, second, third, fourth and fifth operating modes, wherein the control module opens the first, second and fourth valves and closes the third and fifth valves in the first operating mode, wherein the control module opens the first, third and fifth valves and closes the second and fourth valves in the second operating mode, wherein the control module opens the first and fifth valves and closes the second, third and fourth valves in the third operating mode, wherein the control module opens the third and fifth valves and closes the first, second and fourth valves in the fourth operating mode, and wherein the control module opens the fifth valve and closes the first, second, third and fourth valves in the fifth operating mode.

10. The compressor of claim 1, wherein a motor driving said crankshaft is disposed in said interior volume of said crankcase.

11. The compressor of claim 1, further comprising a discharge valve allowing fluid flow from the first compression chamber to the first discharge passage and restricting fluid flow from the first discharge passage to the first compression chamber.

12. The compressor of claim 1, wherein said first discharge passage extends through said first piston.

13. The compressor of claim 1, wherein said first discharge passage is formed in a cylinder head.

14. The compressor of claim 13, wherein a conduit fluidly connects said first discharge passage with said interior volume.

15. The compressor of claim 14, wherein said cylinder head defines a discharge plenum that receives working fluid from said first discharge passage and provides working fluid to said conduit.

16. A compressor for compressing a working fluid, said compressor comprising a crankcase defining an interior volume;

a crankshaft disposed within said crankcase;

a first piston connected to said crankshaft;

a second piston connected to said crankshaft;

a first cylinder receiving said first piston, said first piston and said first cylinder defining a first compression chamber;

a second cylinder receiving said second piston, said second piston and said second cylinder defining a second compression chamber;

a first suction plenum in selective fluid communication with said first compression chamber, said first compression chamber drawing said working fluid from said first suction plenum, said first suction plenum including a first inlet through which working fluid flows into said first suction plenum;

a first discharge passage through which compressed working fluid from said first compression chamber flows to said interior volume of said crankcase;

a second suction plenum in selective fluid communication with said second compression chamber, said second compression chamber drawing working fluid from said second suction plenum, said second suction plenum including a second inlet through which working fluid flows into said second suction plenum from said interior volume of said crankcase;

a first valve controlling fluid flow into said first suction plenum through said first inlet;

a second valve controlling fluid flow into said second suction plenum through said second inlet; and a third valve controlling fluid flow into said second suction plenum through a third inlet.

17. The compressor of claim 16, wherein said crankcase includes a liquid-injection inlet through which a liquid component of said working fluid bypasses said first compression chamber, and wherein said crankcase includes a vapor-injection inlet through which a vapor component of said working fluid bypasses said first compression chamber, and wherein the compressor further comprises:

a fourth valve controlling a flow of said vapor working fluid into said interior volume of said crankcase through said vapor-injection inlet; and a fifth valve controlling a flow of said liquid working fluid into said interior volume of said crankcase through said liquid-injection inlet.

18. The compressor of claim 17, further comprising a control module operable to switch the compressor between first, second, third, fourth and fifth operating modes, wherein the control module opens the first, second and fourth valves and closes the third and fifth valves in the first operating mode, wherein the control module opens the first, third and fifth valves and closes the second and fourth valves in the second operating mode, wherein the control module opens the first and fifth valves and closes the second, third and fourth valves in the third operating mode, wherein the control module opens the third and fifth valves and closes the first, second and fourth valves in the fourth operating mode, and wherein the control module opens the fifth valve and closes the first, second, third and fourth valves in the fifth operating mode.

19. The compressor of claim 16, further comprising a discharge valve allowing fluid flow from the first compression chamber to the first discharge passage and restricting fluid flow from the first discharge passage to the first compression chamber.

20. The compressor of claim 16, wherein said first discharge passage extends through said first piston.

21. The compressor of claim 16, wherein said first discharge passage is formed in a cylinder head, wherein a conduit fluidly connects said first discharge passage with said interior volume, and wherein said cylinder head defines a discharge plenum that receives working fluid from said first discharge passage and provides working fluid to said conduit.

* * * * *